United States Patent [19]

Hanamoto et al.

[11] Patent Number: 4,997,329

[45] Date of Patent: Mar. 5, 1991

[54] APPARATUS FOR CUTTING AND REMOVING PACKAGE MATERIAL

[75] Inventors: Masasi Hanamoto; Yoshiaki Nogami, both of Tokyo, Japan

[73] Assignee: Kirin Beer Kabushiki Kaisha, Tokyo, Japan

[21] Appl. No.: 303,307

[22] Filed: Jan. 27, 1989

[30] Foreign Application Priority Data

Jan. 29, 1988 [JP] Japan ..... 63-17449
Dec. 21, 1988 [JP] Japan ..... 63-322608

[51] Int. Cl.[5] ..... B65B 69/00
[52] U.S. Cl. ..... 414/412; 83/402
[58] Field of Search ..... 414/412; 83/402, 22

[56] References Cited

U.S. PATENT DOCUMENTS

| | | | |
|---|---|---|---|
| 3,884,010 | 5/1975 | Bardo et al. | 414/412 X |
| 4,158,417 | 6/1979 | Inoue | 414/412 |
| 4,285,625 | 8/1981 | Yamada | 414/412 |
| 4,344,268 | 8/1982 | Wakamatsu et al. | 414/412 X |
| 4,348,801 | 9/1982 | Dumont et al. | 414/412 X |
| 4,681,507 | 7/1987 | Mojden et al. | 414/412 X |
| 4,696,615 | 9/1987 | Ettischer et al. | 414/412 X |

FOREIGN PATENT DOCUMENTS

| | | | |
|---|---|---|---|
| 41498 | 9/1981 | Japan . | |
| 41030 | 3/1983 | Japan . | |
| 2105288 | 5/1983 | United Kingdom | 414/412 |

*Primary Examiner*—David A. Bucci
*Attorney, Agent, or Firm*—Ladas & Parry

[57] ABSTRACT

An apparatus for cutting open and removing a sheet-like package material from an elongate packaged object such as a stack of can ends includes a device for stretching the package material to form a loop-like slackened portion of the package material extending in a longitudinal direction of the packaged object, a cutter for cutting open the slackened portion, and a moving device for continuously moving the package material in the longitudinal direction of the packaged object. The package material wrapped around the packaged object is stretched to form the slackened portion. While the packaged object and the cutter are being moved relatively to each other, the slackened portion is continuously cut open by the cutter, and the cut-open package material is removed from the packaged object by a removing device.

2 Claims, 14 Drawing Sheets

PRIOR ART

APPARATUS FOR CUTTING AND REMOVING PACKAGE MATERIAL

BACKGROUND OF THE INVENTION

The present invention relates to an apparatus for cutting and removing a package material from a packaged object, and more particularly to an apparatus for cutting and removing a package material from a cylindrical packaged object.

Ends to be attached to open-top food cans which will be filled with beer, beverage, or the like are stacked after they have been manufactured, then packaged and sent to a canning process. In the canning process, the package is removed from an end stack, and the ends are supplied one at a time to an open-top can which has been filled with a content and positioned for end seaming. Then, the end is placed on the open top of the can and attached thereto by seaming.

Japanese Laid-Open Patent Publication No. 58-41030 discloses an apparatus for removing a package sheet from a packaged cylindrical object such as a stack of can ends. As shown in FIGS. 24(*a*) and 24(*b*) of the accompanying drawings, the disclosed apparatus includes a pair of lower rollers 41, 42 for receiving a packaged cylindrical object 43 wrapped by a package paper 44. The lower rollers 41, 42 are rotated in contact with the object 43 to stretch the package paper 44, thereby forming a slackened portion between the rollers 41, 42. The slackened portion of the package paper 44 is then longitudinally cut by a cutter 45 [see FIG. 24(*a*)]. Thereafter, a pair of upper rollers 47, 48 held in contact with the object 44 is rotated to grip the package paper 44 therebetween and remove the package paper 44 upwardly [see FIG. 24(*b*)].

Another known package paper remover is disclosed in Japanese Laid-Open Patent Publication No. 56-41498. According to the disclosed package paper remover, as shown in FIGS. 25(*a*) through 25(*d*) of the accompanying drawings, a package paper 54 wrapping a cylindrical object 53 on a v-shaped receiver 56 is gripped by a pair of grippers 51, 52, and the packaged object 53 is lifted off the receiver 56 to make a stretched portion of the package paper 54. A cutter 55 is operated to cut the stretched portion of the package paper 54 [FIG. 25(*b*)]. Then, the grippers 51, 52 are opened to drop the object 53 onto the receiver 56 [FIG. 25(*c*)], after which the packaged object 53 is placed on a pair of rollers 57, 58. The rollers 57, 58 are rotated in opposite directions to draw the package paper 54 therebetween and remove the same from the object 53 [FIG. 25(*d*)].

In both of the above known package removing apparatus, the package paper is pulled to make a slackened or stretched portion, cut, and then removed while the packaged object is being stopped. Where package papers are to be successively removed from a number of packaged objects, a next packaged object must be kept in a standby condition for a long period of time while the package paper is being removed from one packaged object. Therefore, the earlier package removers have a limited capacity when removing package papers from a succession of packaged objects.

With the package removing apparatus disclosed in the former publication, since the lower portion of the package paper 44 is slackened by frictional engagement with the rollers 41, 42, it may not successfully be slackened due to roller slippage or the like, and hence may not successfully be cut by the cutter 45. Another problem is that inasmuch as the cutter 45 approaches the packaged object 43 in order to cut the package paper 44, the cutting edge of the cutter 45 may directly contact the packaged object 43, thus damaging the object 43 or the cutter 45 or both.

According to the package remover disclosed in the latter publication, the packaged object 53 is lifted off the receiver 56 and the cutter 55 is advanced toward the stretched portion of the package paper 54 before the package paper 54 is cut. The packaged object 53 must therefore be lifted or suspended horizontally for proper positional relationship to the cutter 55. Because the grippers 51, 52 are associated with a lifting device, the entire package removing apparatus is complex in structure and highly costly. The cutting edge of the cutter 55 may also directly contact the packaged object 53, thus damaging the object 53 or the cutter 55 or both.

SUMMARY OF THE INVENTION

In view of the aforesaid drawbacks of the conventional package removing apparatus, it is an object of the present invention to provide an apparatus of a simple structure which is capable of cutting a package material and removing the same from a packaged object without stopping the packaged object, with eliminating any damage to the packaged object or a cutter or both and eliminating any process of lifting the packaged object.

To achieve the above object, there is provided in accordance with the present invention an apparatus for cutting open and removing a sheet-like package material from an elongate packaged object, comprising means for stretching the package material to form a loop-like slackened portion of the package material extending in a longitudinal direction of the packaged object, a cutter for cutting open the slackened portion, a moving device for moving the package material and the cutter relatively to each other in the longitudinal direction of the packaged object, and a removing device for removing the cut-open package material from the packaged object.

The package material wrapped around the packaged object is stretched to form the slackened portion. While the packaged object or the cutter is being moved by the moving device to move the packaged object and the cutter relatively to each other, the slackened portion is continuously cut open by the cutter, and the cut-open package material is removed from the packaged object by the removing device.

The above and other objects, features and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

FIGS. 1 through 14 and 15(*a*) through 15(*d*) shown an apparatus for cutting and removing a package material according to a first embodiment of the present invention.

Figure 1:
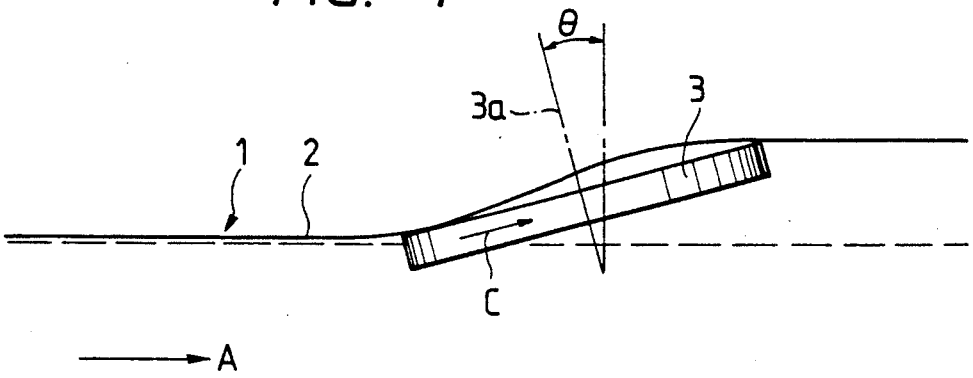
FIG. 1 is a front elevational view showing the principles of operation of a first embodiment of the present invention.
Figure 2:
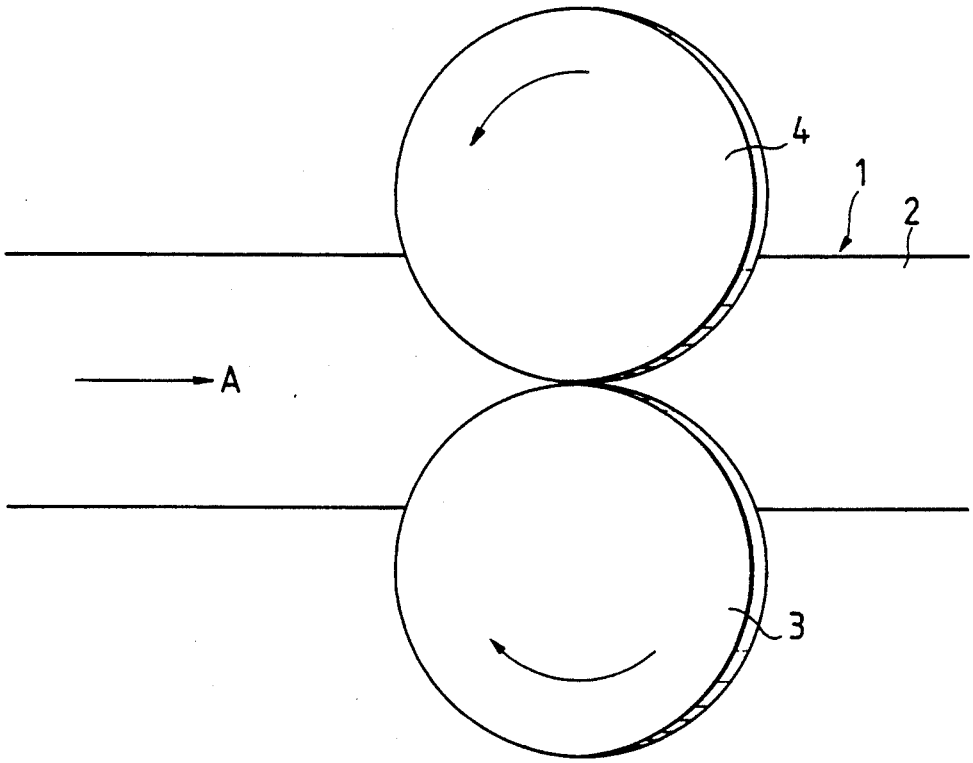
FIG. 2 is a plan view showing the principles of operation of the first embodiment.
Figure 3:
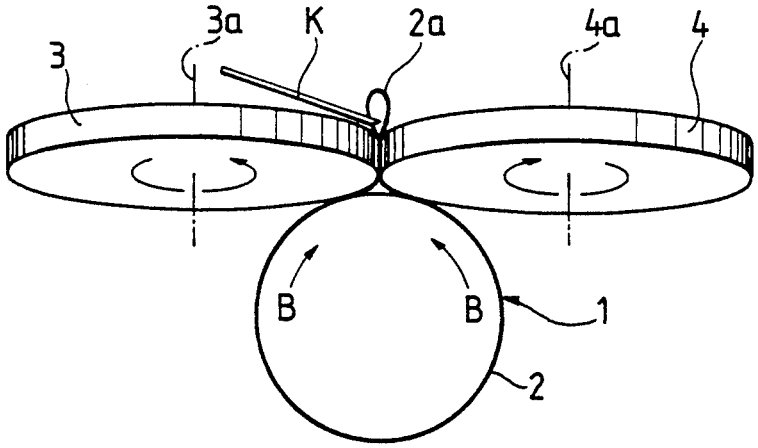
FIG. 3 is a side elevational view showing the principles of operation of the first embodiment.

FIGS. 1 through 3 illustrate the principles of operation of the first embodiment. A packaged object 1 such as a stack of can ends is moved in its longitudinal direction indicated by the arrow A. The packaged object 1 is of a cylindrical shape having a predetermined length and is covered with a sheet-like package material 2. A pair of rotatable rollers 3, 4 made of a resilient material and having respective outer peripheral surfaces held against each other is disposed on the path of movement of the packaged object 1, the rollers 3, 4 being engageable with an upper surface of the packaged object 1 as it moves. The rollers 3, 4 are rotatable about their own axes 3*a*, 4*a*, respectively, extending parallel to each other and inclined a given angle $\theta$ from the vertical direction such that upper portions of the axes 3*a*, 4*a* are positioned upstream of lower portions thereof with respect to the direction (indicated by the arrow A) of movement of the packaged object 1.

Figure 4:
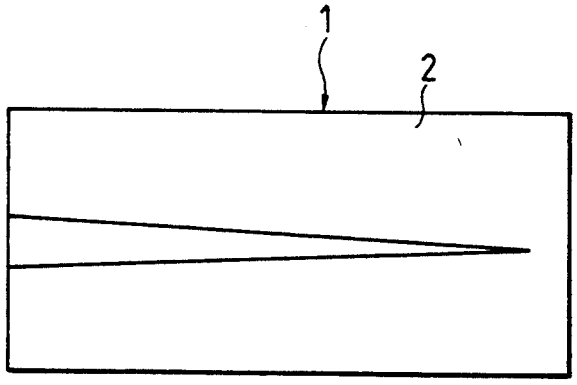
FIG. 4 is a view illustrating the manner in which a package material is cut.

When the packaged object 1 is moved in the direction of the arrow A into contact with the rollers 3, 4, the package material 2 wrapped around the object 1 is subjected to forces tending to pull the package material 2 in the directions of the arrows B in FIG. 3 to form a loop-like slackened portion 2*a* on the upper surface of the packaged object 1. Since the rollers 3, 4 are inclined upstream with respect to the direction of travel of the packaged object 1, rotation of the rollers 3, 4 provides forces tending to pull the package material 2 obliquely upwardly as indicated by the arrow C in FIG. 1. On continued movement of the packaged object 1 in the direction of the arrow A, the loop-like slackened portion 2*a* of the package material 2 is continuously formed in the longitudinal direction of the packaged object 1. Therefore, as illustrated in FIG. 3, a cutter K positioned slightly upwardly of the region where the rollers 3, 4 contact the packaged object 1 can cut open the slackened portion 2*a* of the package material 2 in the axial direction thereof, as shown in FIG. 4. The cutter K may be separate from the rollers 3, 4 as shown in FIG. 3, or rotary cutters may be integrally formed with the rollers 3, 4, respectively.

An apparatus for cutting and removing a package material according to the first embodiment will hereinafter be described with reference to FIGS. 5 through 14 and 15(*a*) through 15(*d*).

Figure 5:
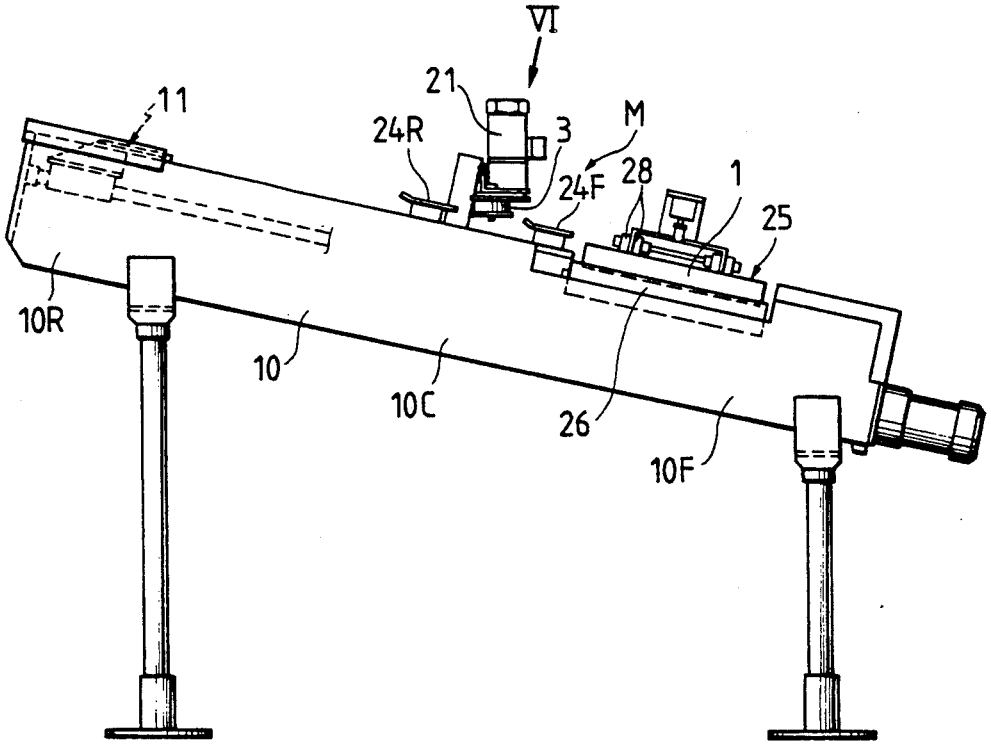
FIG. 5 is a front elevational view of an apparatus for cutting and removing a package material according to the first embodiment.
Figure 6:
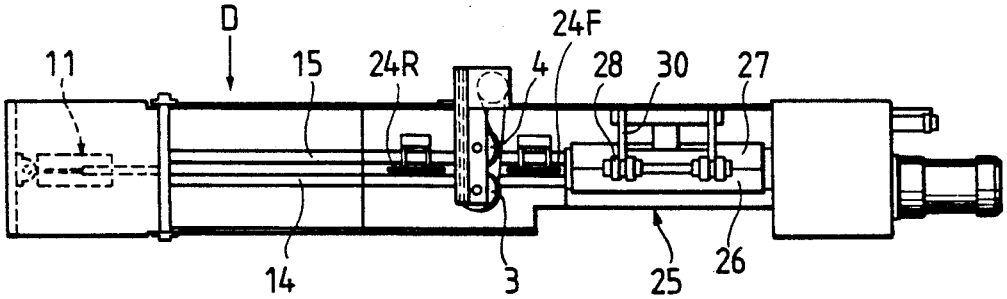
FIG. 6 is a plan view of the apparatus as viewed in the direction of the arrow VI.

FIG. 5 shows in side elevation the apparatus generally designated by M. The apparatus M includes a frame 10 supporting a pusher 11 of a packaged object moving device on a rear portion 10R thereof. The frame 10 also supports a pair of rotatable rollers 3, 4 on a central portion 10C thereof and a package material removing device 25 on a front portion 10F thereof for stripping off a package material 2 from a packaged object 1. The frame 10 is shown as being inclined for the reason of adapting itself to a next process, but may lie horizontally. The packaged object 1 is moved from the rear frame portion 10R (upstream side) toward the front frame portion 10F (downstream side). As illustrated in FIG. 6, a pair of guide members 14, 15 is disposed on the frame 10 in the longitudinal direction thereof for supporting and guiding the packaged object 1 at its opposite sides when the packaged object 1 is moved along the guide members 14, 15.

Figure 7:
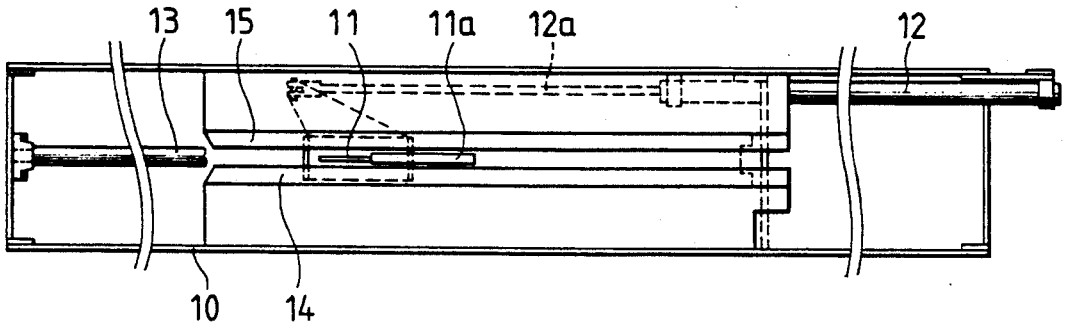
FIG. 7 is a plan view of a packaged object moving device of the apparatus.
Figure 8:
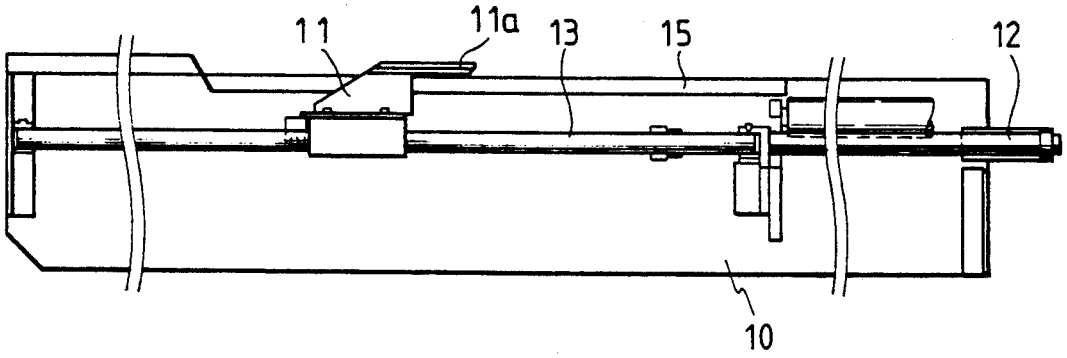
FIG. 8 is a sectional side elevational view of the packaged object moving device.
Figure 9:
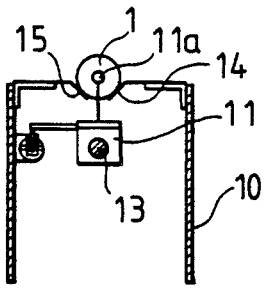
FIG. 9 is a transverse cross-sectional view of the packaged object moving device.

As illustrated in FIGS. 7 through 9, the pusher 11 is coupled to a longitudinally movable rod 12*a* of an air cylinder 12 and fitted over a guide rod 13 disposed longitudinally in the frame 10. The pusher 11 is therefore movable back and forth along the guide rod 13 in response to operation of the air cylinder 12. The pusher 11 has a pusher rod 11*a* on its upper portion for pushing the trailing end of the packaged object 1 placed on the guide members 14, 15 to move the packaged object 1 forwardly or downstream when the pusher 11 is moved downstream along the guide rod 13.

Figure 10:
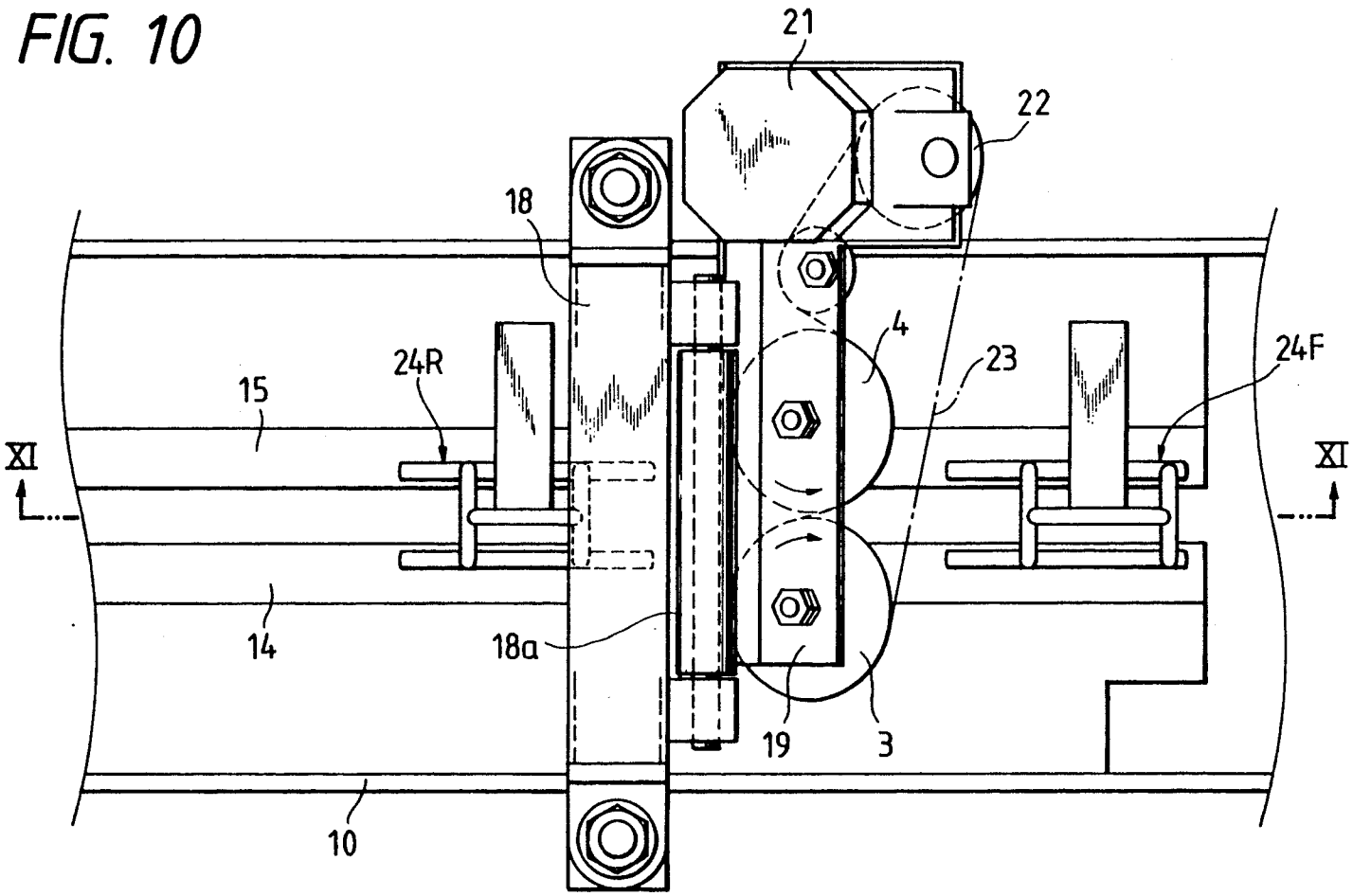
FIG. 10 is a plan view of rollers and a cutter of the apparatus.
Figure 11:
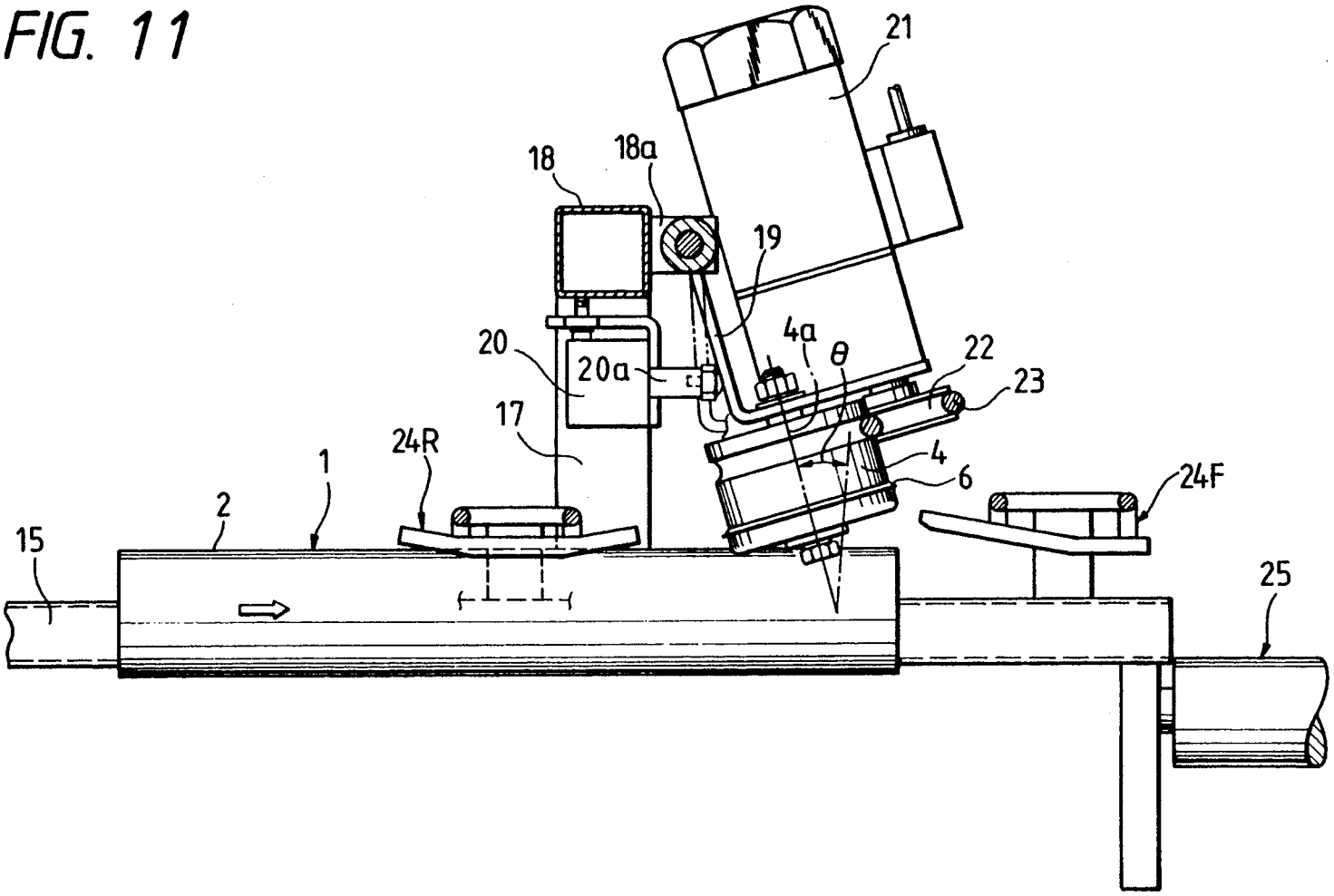
FIG. 11 is a cross-sectional view taken along line XI—XI of FIG. 10.
Figure 12:
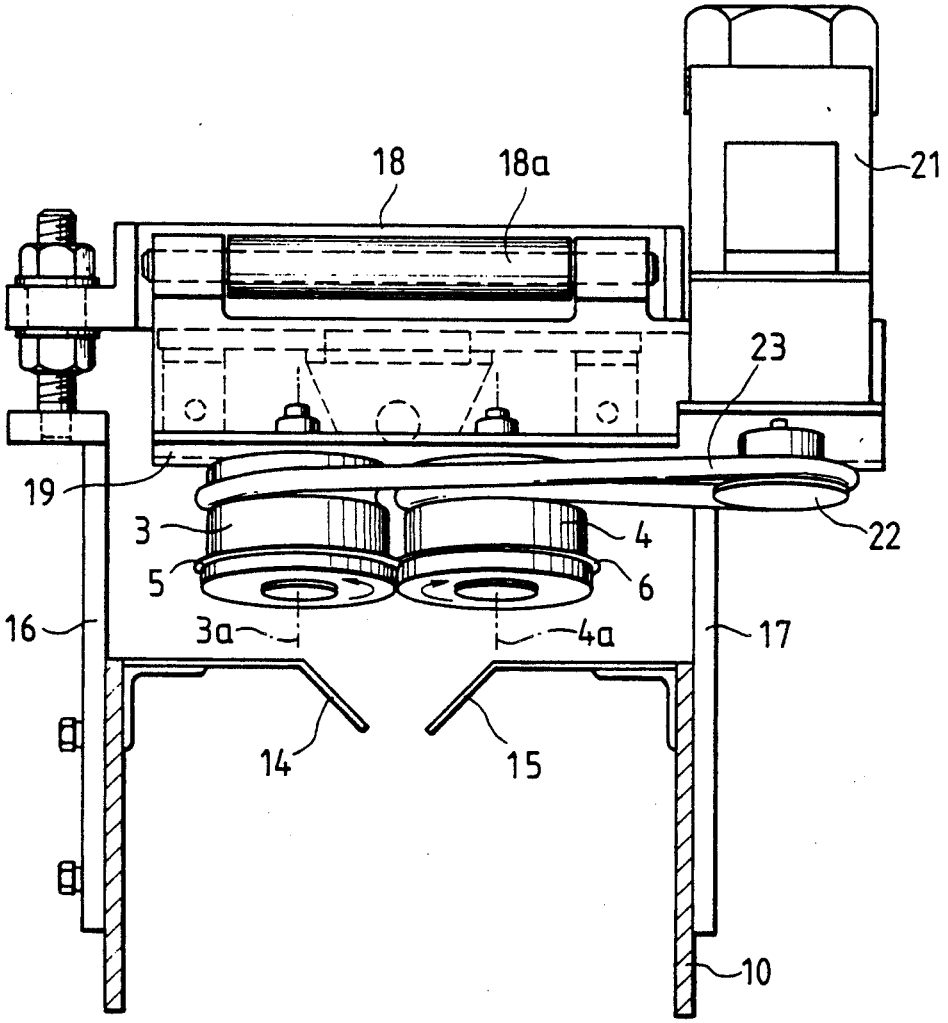
FIG. 12 is a side elevational view of the rollers and the cutter.

As shown in FIGS. 10 through 12, the rollers 3, 4 are disposed slightly above the guide members 14, 15, respectively, and supported on a beam member 18 extending transversely between side plates 16, 17 mounted vertically on the frame 10. The beam member 18 has a bearing 18*a* from which a support side plate 19 of an L-shaped cross section is swingably suspended. The rollers 3, 4 are rotatably supported on the support side plate 19.

The rollers 3, 4 are rotatable about their own axes 3*a*, 4*a*, respectively, extending parallel to each other and inclined a given angle $\theta$ from the vertical direction such that upper portions of the axes 3*a*, 4*a* are positioned upstream of lower portions thereof with respect to the direction of movement of the packaged object 1. The angle $\theta$ of inclination can be varied by extending or retracting an operating rod 20*a* of a short cylinder 20 fixed to the beam member 18 to swing the support side plate 19. A belt 23 of a circular cross section is trained around the rollers 3, 4 and a driver pulley 22 directly coupled to a drive motor 21 mounted on the support side plate 19. The rollers 3, 4 can be rotated in the directions of the arrows by frictional engagement between the belt 23 and the rollers 3, 4 when the drive motor 21 is energized. The rollers 3, 4 have integral rotary cutter blades 5, 6, respectively, around their outer peripheral surfaces, the rotary cutter blades 5, 6 serving as a scissors-like cutter for sandwiching and cutting the package material 2. Two holder members 24R, 24F are disposed respectively upstream and downstream of the rollers 3, 4 for holding the upper surface of the package material 1 to prevent the package material 1 from being lifted off the guide members 14, 15.

Figure 13:
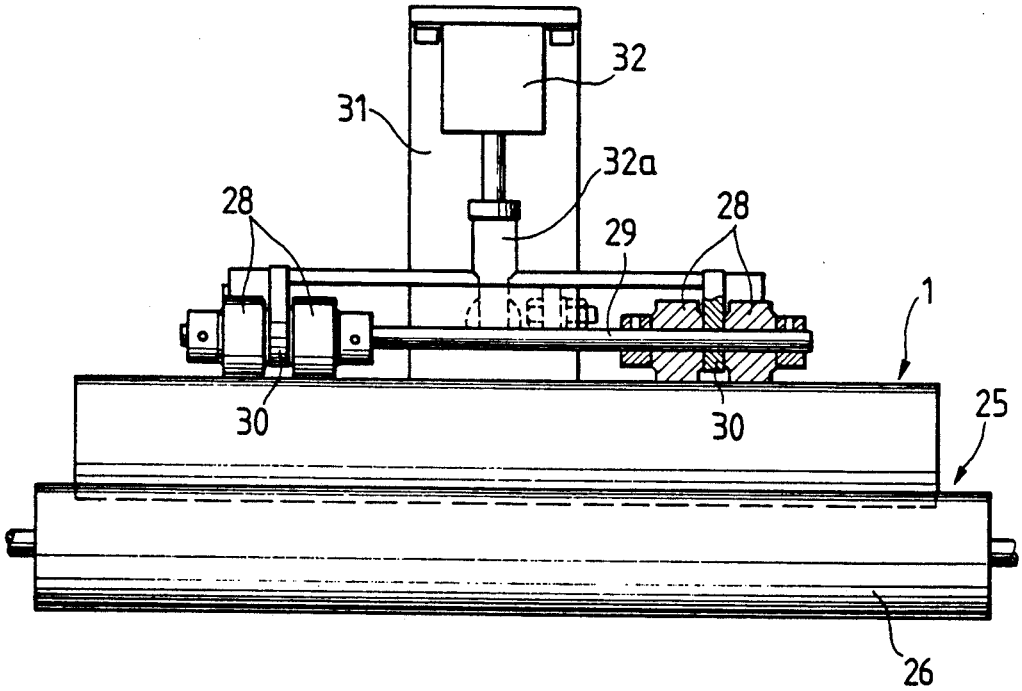
FIG. 13 is a front elevational view of a package material removing device of the apparatus.
Figure 14:
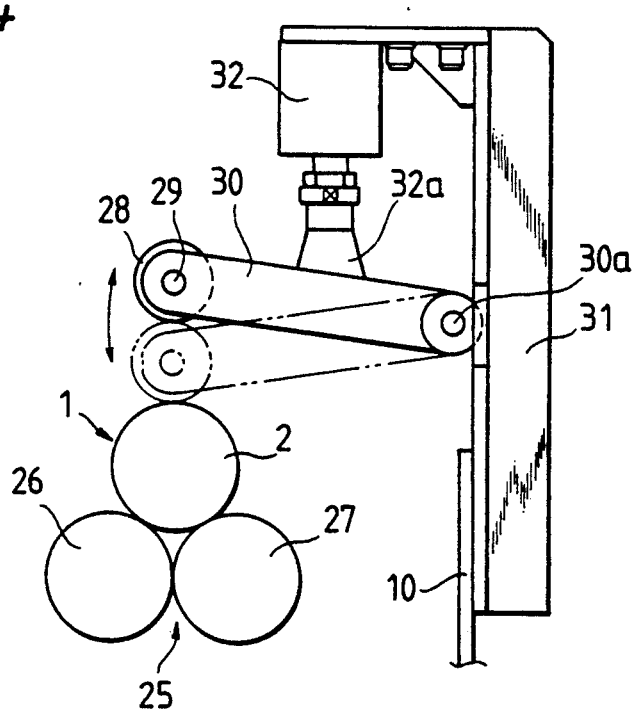
FIG. 14 is a side elevational view of the package material removing device.
Figure 15A:
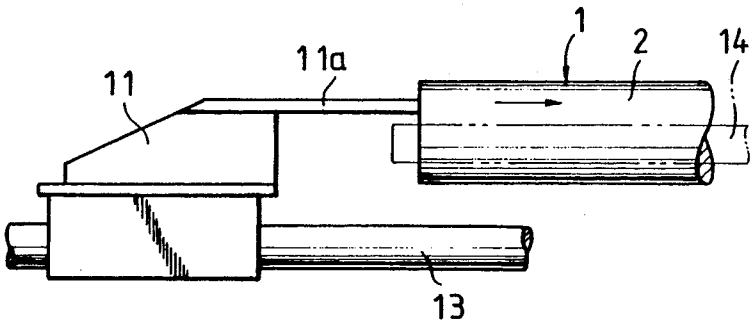
FIGS. 15(*a*) through 15(*d*) are views showing operation of the apparatus.
Figure 15B:
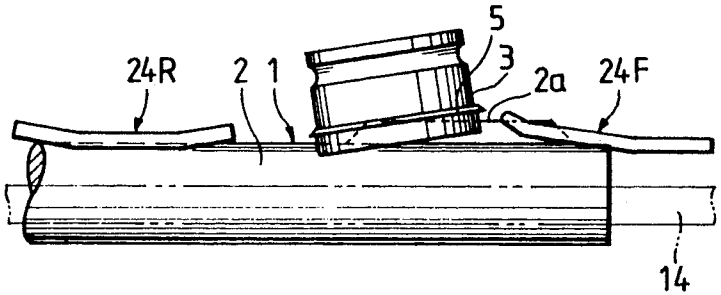
Figure 15C:
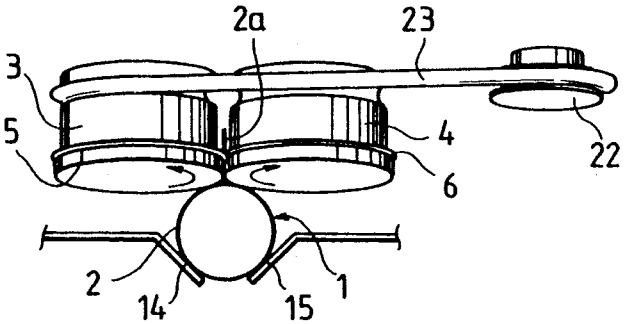
Figure 15D:
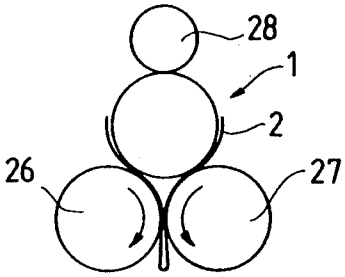

The package material removing device 25 which is positioned slightly downstream of the rollers 3, 4 comprises a pair of stripping rollers 26, 27 positioned with their outer peripheral surfaces held against each other, as shown in FIGS. 13 and 14. The package material 2 which has been cut open by the rotary cutter blades 5, 6 is placed on the rollers 26, 27, which are rotated in the opposite directions to remove the package material 2 from the object 1. A plurality of coaxial presser rollers 28 are disposed above the stripping rollers 26, 27 for holding down the upper surface of the packaged object 1 on the stripping rollers 26, 27 to press the object 1 against the stripper rollers 26, 27 for reliable removal of the package material 2 from the object 1. The presser rollers 28 are rotatably supported on one end of swing arms 30 by a shaft 29, and the swing arms 30 are pivotally supported at the other end on a side plate 31 by a pivot shaft 30*a*, the side plate 31 being vertically mounted on the frame 10. The swing arms 30 are coupled to an operating rod 32*a* of a short cylinder 32. The swing arm 30 is therefore swingable about the pivot shaft 30*a* in the directions of the arrows when the operating rod 32*a* is extended and retracted by the cylinder 32.

Operation of the package material cutting and removing apparatus of the above construction will be described below with reference to FIGS. 15(*a*) through 15(*d*).

The packaged object 1 is supplied onto the guide members 14, 15 of the apparatus M in the direction of the arrow D (FIG. 6). The air cylinder 12 is operated to move the pusher 11 forwardly to cause the pusher rod 11*a* to push the trailing end of the packaged object 1, thereby moving the packaged object 1 in the direction of the arrow in FIG. 15(*a*). When the leading end of the packaged object 1 reaches the rollers 3, 4, the packaged object 1 is brought into contact with the rollers 3, 4 while it is being held down by the holder members 24R, 24F against upward displacement as shown in FIG. 15(*b*). The package material 2 wrapping the outer peripheral surface of the packaged object 1 is now stretched obliquely upwardly to form a loop-like slackened portion 2*a* on the upper surface of the object 1. As the packaged object 1 is further moved downstream, the loop-like slackened portion 2*a* of the package material 2 is continuously formed in the longitudinal direction of the packaged material 1. At this time, the loop-like slackened portion 2*a* is sandwiched and cut open by the rotary cutter blades 5, 6 of the rollers 3, 4 as shown in FIG. 15(*c*). Although the package material 2 at the leading end of the packaged object 1 remains uncut, the following portion of the package material 2 is continuously cut open in the longitudinal direction.

After the package material 2 has been cut open, the packaged object 1 is continuously pushed downstream by the pusher 11 so that it is delivered onto the stripping rollers 26, 27 of the package material removing device 25. When the entire packaged object 1 is put on the stripping rollers 26, 27, the cylinder 32 is actuated to lower the swing arm 30 that has been lifted to an upper position, for enabling the presser rollers 28 to hold the upper surface of the packaged object 1 as shown in FIG. 15(*d*). The stripping rollers 26, 27 are now rotated in the opposite directions to start stripping off the package material 2 from the object 1. The uncut portion of the package material 2 at the leading end of the object 1 is forcibly torn apart when the package material 1 is pulled due to frictional forces produced between the stripping rollers 26, 27 and the package material 2. Therefore, the package material 2 is finally completely removed from the object 1.

An apparatus for cutting and removing a package material according to a second embodiment of the present invention will be described below with reference to FIGS. 16 through 22 and 23(*a*) through 23(*d*).

Figure 17:
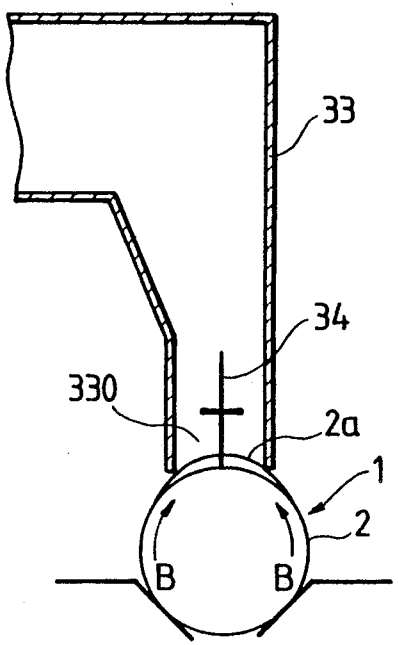
FIG. 17 is a cross-sectional view showing the principles of operation of the second embodiment.
Figure 16:
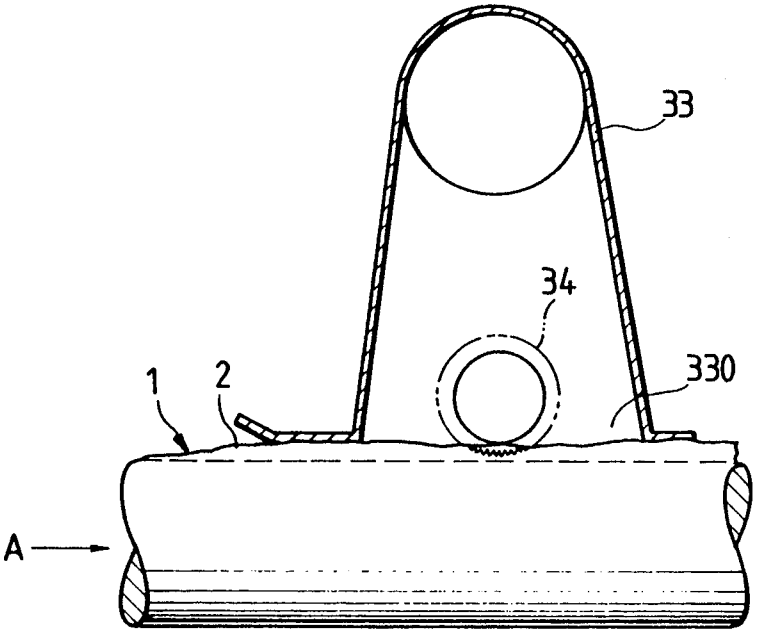
FIG. 16 is a sectional front elevational view showing the principles of operation of a second embodiment of the present invention.

FIGS. 16 and 17 illustrate the principles of operation of the second embodiment. A packaged object 1 such as a stack of can ends is moved in its longitudinal direction indicated by the arrow A. The packaged object 1 is of a cylindrical shape having a predetermined length and is covered with a sheet-like package material 2. A suction opening 33*o* of a vacuum duct 33 coupled to a vacuum pump (not shown) is positioned in the path of movement of the packaged object 1 closely to the upper surface of the packaged object 1. The package material 2 wrapping the outer periphery of the object 1 is drawn upwardly under suction by a vacuum developed in the vacuum duct 33 by the vacuum pump. A circular cutter 34 which lies in a vertical plane is disposed in the vacuum duct 33 near the suction opening 33*o*.

When the packaged object 1 is moved in the direction of the arrow A into a position underneath the suction opening 33*o*, the package material 2 wrapped around the object 1 is subjected to forces tending to pull the package material 2 in the directions of the arrows B in FIG. 17 to form a loop-like slackened portion 2*a* on the upper surface of the packaged object 1.

On continued movement of the packaged object 1 in the direction of the arrow A, the loop-like slackened portion 2*a* of the package material 2 is continuously formed in the longitudinal direction of the packaged object 1. As illustrated in FIG. 17, the cutter 34 that is positioned slightly above the slackened portion 2*a* is rotated to cut open the slackened portion 2*a* in the axial direction while the packaged object 1 is being moved.

An apparatus for cutting and removing a package material according to the second embodiment will hereinafter be described with reference to FIGS. 18 through 22 and 23(*a*) through 23(*d*).

Figure 18:
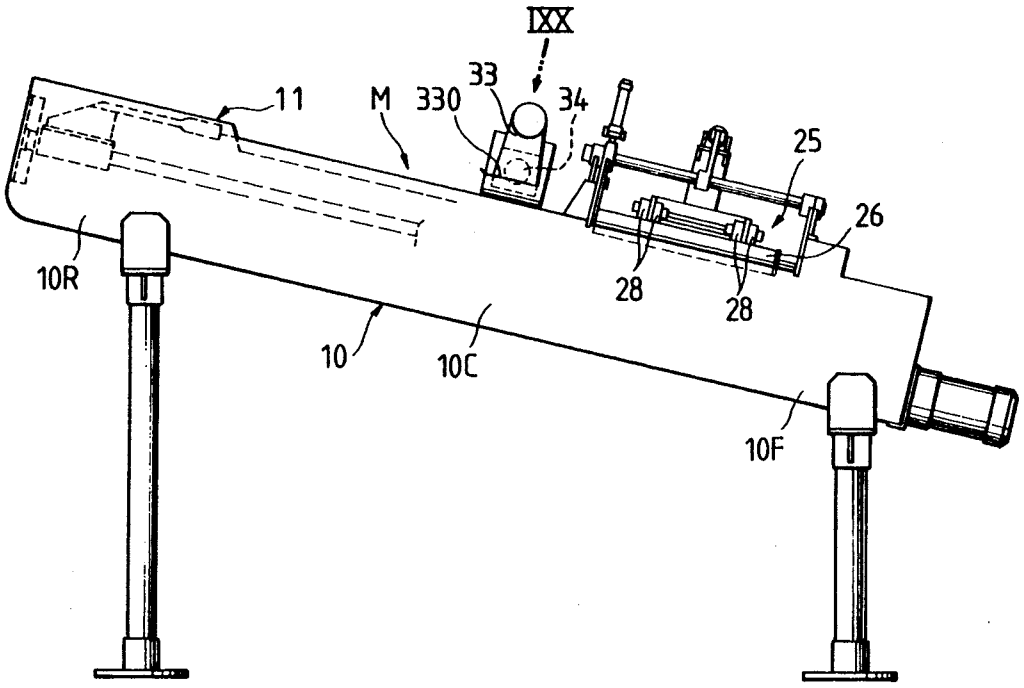
FIG. 18 is a front elevational view of an apparatus for cutting and removing a package material according to the second embodiment.
Figure 19:
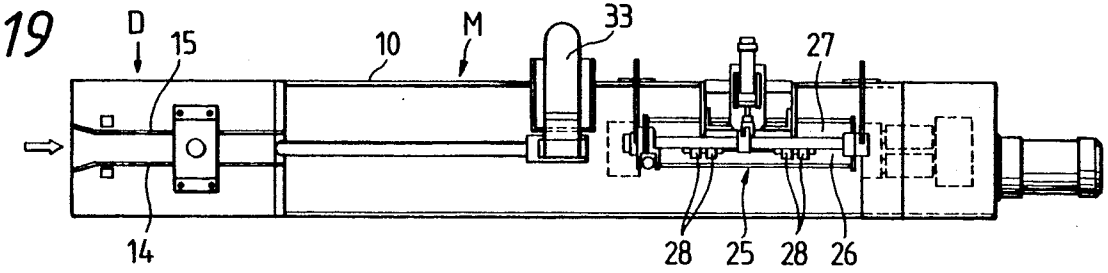
FIG. 19 is a plan view of the apparatus as viewed in the direction of the arrow IXX.

FIG. 18 shows in side elevation the apparatus generally designated by M. The apparatus M includes a frame 10 supporting a pusher 11 of a packaged object moving device on a rear portion 10R thereof. The frame 10 also supports the suction opening 33*o* and the cutter 34 on a central portion 10C thereof and a package material removing device 25 on a front portion 10F thereof for stripping off a package material 2 from a packaged object 1. The pusher 11 and the package material removing device 25 are identical in structure and operation to those of the first embodiment. The frame 10 is shown as being inclined for the reason of adapting itself to a next process, but may lie horizontally. The packaged object 1 is moved from the rear frame portion 10R (upstream side) toward the front frame portion 10F (dowbstream side). As illustrated in FIG. 19, a pair of guide members 14, 15 is disposed on the frame 10 in the longitudinal direction thereof for supporting and guiding the packaged object 1 at its opposite sides when the packaged object 1 is moved along the guide members 14, 15.

Figure 20:
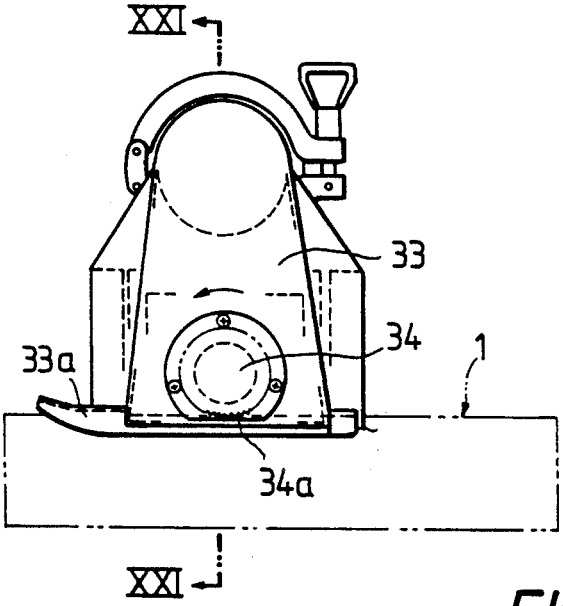
FIG. 20 is a view showing a suction opening and a cutter of the apparatus of the second embodiment.
Figure 21:
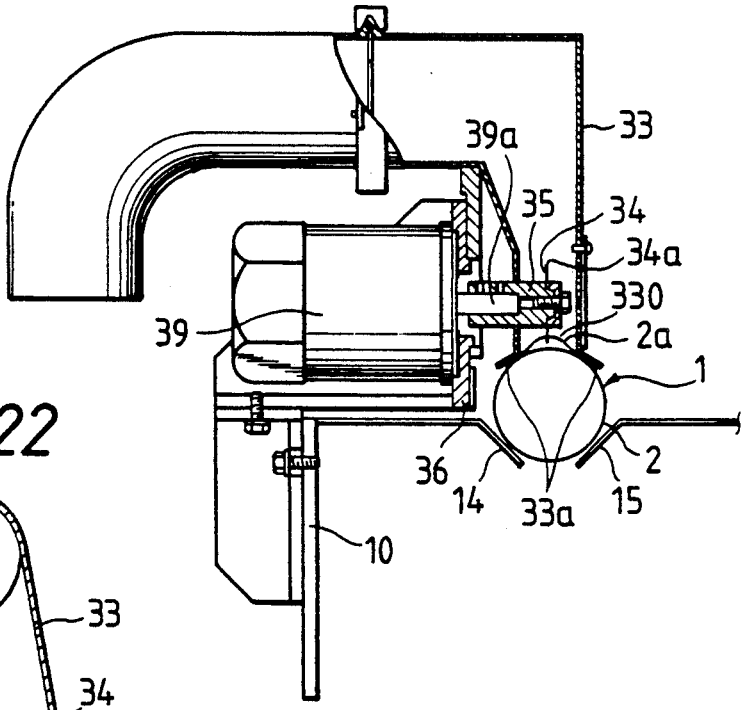
FIG. 21 is a cross-sectional view taken along line XXI—XXI of FIG. 20.
Figure 22:
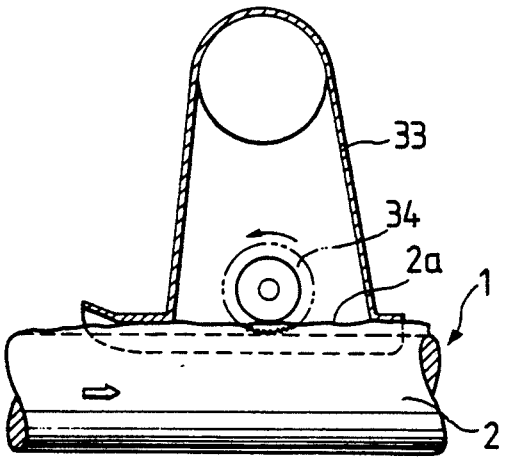
FIG. 22 is a sectional front elevational view showing the suction opening and the cutter.
Figure 23A:
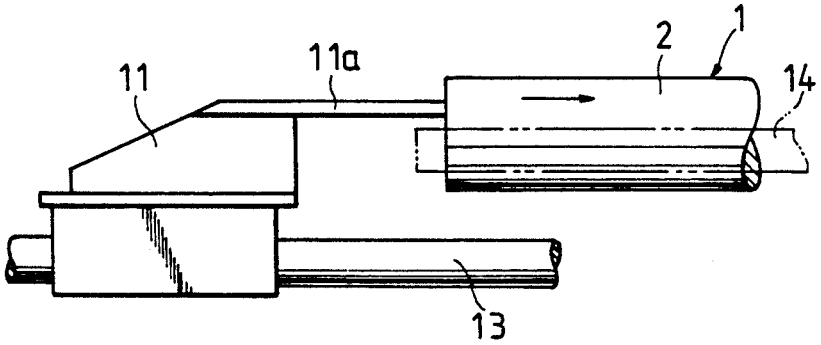
FIGS. 23(*a*) through 23(*d*) are views showing operation of the apparatus of the second embodiment.
Figure 23B:
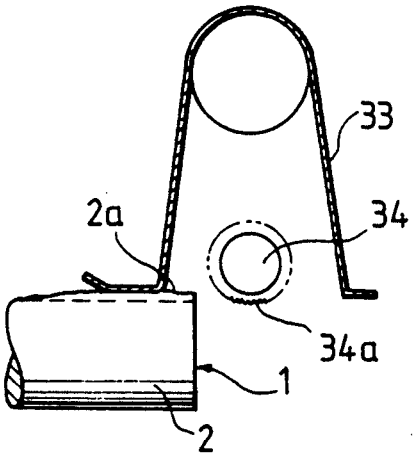
Figure 23C:
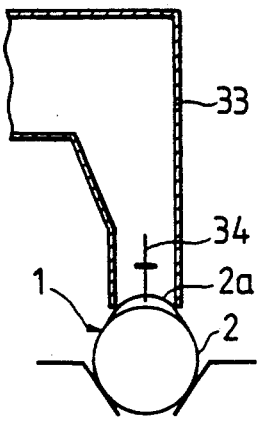
Figure 23D:
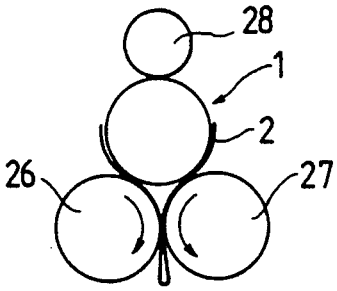
Figure 24A:
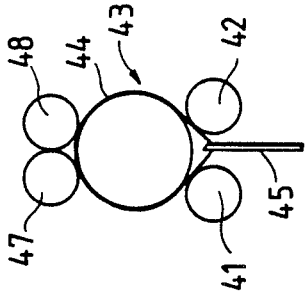
FIGS. 24(*a*) and 24(*b*) are views illustrating an operation sequence of a conventional apparatus for cutting and removing a package material.
Figure 24B:
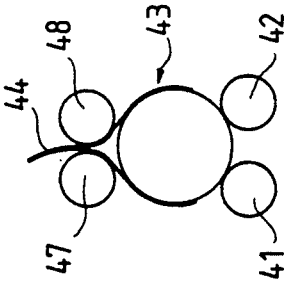
PRIOR ART FIG. 24(b)
Figure 25A:
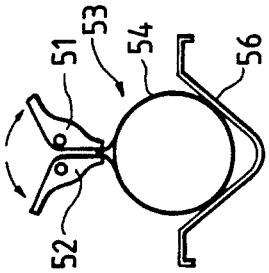
PRIOR ART FIG. 25(a)
FIGS. 25(*a*) through 25(*d*) are views showing an operation sequence of another conventional apparatus for cutting and removing a package material.
Figure 25B:
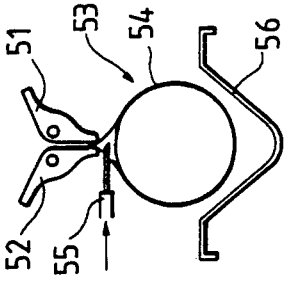
PRIOR ART FIG. 25(b)
Figure 25C:
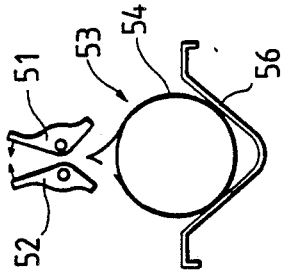
PRIOR ART FIG. 25(c)
Figure 25D:
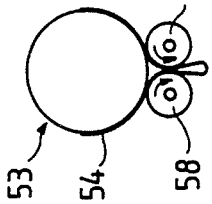
PRIOR ART FIG. 25(d)

As illustrated in FIGS. 20 through 22, the suction opening 33*o* of the vacuum duct 33 and the cutter 34 are disposed slightly upwardly of the guide members 14, 15. The vacuum duct 33 and the cutter 34 are supported on a support member 36 vertically mounted on the frame 10. More specifically, the vacuum duct 33 is fixed to the support member 36 and has its lower end open into the suction opening 33*o*. A motor 39 is fixedly supported on the support member 36 and has a rotatable shaft 39*a*. To the rotatable shaft 39*a*,. there is secured a support shaft 35 supporting the cutter 34 which has a saw-toothed cutter blade 34*a* on its outer periphery. The cutter 34 is positioned near the suction opening 33*o*.

Guides 33*a* bent outwardly from the suction opening 33*o* are formed on the lower end of the vacuum duct 33 for slidingly guiding opposite sides of the packaged object 1.

Operation of the packaged material cutting and removing apparatus thus constructed according to the second embodiment will be described below with reference to FIGS. 23(*a*) through 23(*d*).

The package object 1 is supplied onto the guide members 14, 15 of the apparatus M in the direction of the arrow D (FIG. 19). The air cylinder coupled to the pusher 11 is operated to move the pusher 11 forwardly to cause the pusher rod 11*a* to push the trailing end of the packaged object 1, thereby moving the packaged object 1 in the direction of the arrow in FIG. 23(*a*). When the leading end of the packaged object 1 reaches the suction opening 33*o*, a vacuum developed in the vacuum duct 33 by the vacuum pump is applied to the packaged material 1 to upwardly stretch the package material 2 wrapping the outer peripheral surface of the packaged object 1, to form a loop-like slackened portion 2*a* on the upper surface of the object 1. As the packaged object 1 is further moved downstream, the loop-like slackened portion 2*a* of the package material 2 is continuously formed in the longitudinal direciton of the packaged material 1. At this time, the loop-like slackened portion 2*a* is continuously cut open by the cutter 34 as shown in FIG. 23(*c*).

After the package material 2 has been cut open, the packaged object 1 is continuously pushed downstream by the pusher 11 so that it is delivered onto the stripping rollers 26, 27 of the package material removing device 25. When the entire packaged object 1 is put on the stripping rollers 26, 27, the cylinder 32 is actuated to lower the swing arm 30 that has been lifted to an upper position, for enabling the presser rollers 28 to hold the upper surface of the packaged object 1 as shown in FIG. 23(*d*). The stripping rollers 26, 27 are now rotated in the opposite directions to start stripping off the package material 2 from the object 1. The package material 2 is completely removed from the object 1 by being pulled due to frictional forces produced between the stripping rollers 26, 27 and the package material 2. Cut pieces or debris produced by cutting open the package material 1 is drawn under the vacuum into the suction opening 33*o* and discharged out.

With the present invention, as described above, the package material is simultaneously stretched to form a slackened portion and cut open in one process of operation while the packaged object is being moved, and then the cut-open package material is removed in a next process while the packaged object is held at rest. Therefore, the time required to keep the packaged object stopped is reduced. The processes of cutting open and removing the package material are made highly efficient, increasing the processing capacity of the entire apparatus.

The slackened portion of the package material is formed by a slackened portion forming means, and the package material is cut open by a cutter disposed upwardly of the packaged object. The cutter and the packaged object are kept out of physical contact with each other, and hence the cutter or the packaged object or both are prevented from being damaged.

Furthermore, since the package material can be removed from the packaged object without lifting the packaged object, it is not necessary to provide any lifting device for lifting the packaged object, and the apparatus is relatively simple in overall construction. The procedure for cutting open and removing the package material is simplified.

Although certain preferred embodiments have been shown and described, it should be understood that many changes and modifications may be made therein without departing from the scope of the appended claims.

What is claimed is

1. An apparatus for cutting open and removing a sheet-like package material from an elongated packaged object, said apparatus comprising:

means for continuously moving the package material in a longitudinal direction thereof;

means for creating vacuum condition which is disposed along the package material moving means and provided with a suction opening, said vacuum creating means drawing upwardly the package material of the packaged object to form a loop-like slackened portion of the package material extending in the longitudinal direction of the packaged object;

a cutter disposed immovably in said vacuum creating means near the suction opening and adapted to cut open the slackened portion of the package material, said cutter having a rotation shaft extending in a direction normal to the moving direction of the package material; and means for removing the cut-open package material from the packaged object.

2. An apparatus according to claim 1, wherein said removing means comprises a pair of stripping rollers for frictionally engaging the cut-open package material to remove the same from the packaged object.

* * * * *